United States Patent [19]

Sekiguchi

[11] 4,312,392

[45] Jan. 26, 1982

[54] BAG AND PROCESS FOR MANUFACTURING THE SAME

[75] Inventor: Keiji Sekiguchi, Uozu, Japan

[73] Assignee: Toyama Industry Co., Ltd., Tokyo, Japan

[21] Appl. No.: 131,641

[22] Filed: Mar. 19, 1980

[51] Int. Cl.[3] ..... B65D 33/06

[52] U.S. Cl. ..... 150/3; 112/262.1; 150/12

[58] Field of Search ..... 150/1, 12, 1.7, 3; 112/262.1, 262.2

[56] References Cited

U.S. PATENT DOCUMENTS

| | | | |
|---|---|---|---|
| 835,455 | 11/1906 | Mortensen | 150/12 UX |
| 1,771,168 | 7/1930 | Droutman | 150/1.7 |
| 1,808,375 | 6/1931 | Plooster | 150/1.7 |
| 2,827,939 | 3/1958 | Ames | 150/1 |
| 3,260,292 | 7/1966 | Costello | 150/1.7 |
| 3,961,655 | 6/1976 | Nattrass et al. | 150/1 |
| 4,136,723 | 1/1979 | Skaadel et al. | 150/1 |
| 4,174,059 | 11/1979 | Maunder | 150/1 X |
| 4,194,652 | 3/1980 | Williamson et al. | 150/1 X |
| 4,207,937 | 6/1980 | Sandeman et al. | 150/1 |
| 4,244,408 | 1/1981 | Shoda | 150/1.7 |

FOREIGN PATENT DOCUMENTS

| | | |
|---|---|---|
| 1271376 | 4/1972 | United Kingdom . |
| 1525994 | 9/1978 | United Kingdom . |
| 2021069 | 11/1979 | United Kingdom . |
| 1557784 | 12/1979 | United Kingdom . |

*Primary Examiner*—Donald F. Norton

*Attorney, Agent, or Firm*—Burgess, Ryan and Wayne

[57] ABSTRACT

A bag comprising a bag proper, a bottom end piece defining the bottom portion of the bag proper, a top end piece closing the top end portion of the bag proper and an opening formed in the central portion of the top end piece integrally with the bag proper, wherein a pair of left and right projecting portions formed on either side of the opening are sewn together to form a hanging sling. The above mentioned bag is produced by providing a tubular part having an upper portion corresponding to the opening and having symmetric parts located on the left and right sides of said upper portion which form a hanging sling for the bag. A bottom end is then sewn to the bottom edge of the tubular part to form a bottom for the bag, and superimposed edges of the symmetric parts are sewn to form a top end with a cylindrical opening.

13 Claims, 10 Drawing Figures

BAG AND PROCESS FOR MANUFACTURING THE SAME

BACKGROUND OF THE INVENTION (1) Field of the Invention

The present invention relates to bags for use in storing and transporting bulk materials such as free-flowing powders and granules, particularly a bag having an opening formed in the top portion thereof, and the present invention also relates to a process for manufacturing such a bag.

(2) Description of the Prior Art

In known bags having an opening for filling a material, formed in the top portion thereof, the material-filling opening and the top end cover are separately prepared and sewn together, and the top end cover is then sewn to the bag proper. Accordingly, the sewing operation is very troublesome and the efficiency of the sewing operation is very low.

The top end cover is sewn to the bag proper along the entire length thereof to form a seam. This seam can be broken or loosened by an impact or shock occurring during the loading operation. Accordingly, from the viewpoint of safety, it has been desired to improve the quality of these bags.

SUMMARY OF THE INVENTION

It is the primary object of the present invention to provide a bag for use in storing and transporting bulk materials, which bag has none of the above-mentioned problems exhibited by the conventional bags.

The second object of the present invention is to provide a process for manufacturing a bag for storing purposes, as mentioned above.

In accordance with the present invention, these objects can be attained by a bag comprising a bag proper, a bottom end defining the bottom protion of the bag proper, a top end closing the top end portion of the bag proper and an opening formed in the central portion of the top end integrally therewith, wherein a pair of left and right top ends are formed on each side of the opening and are sewn together to form a hanging sling.

Another aspect the present invention provides a process for manufacturing bags which comprises the steps of forming a cylindrical bag proper having in the upper portion thereof a part to be formed into a top end, said part to be formed into the top end being divided by notches into two flaps to be formed into an opening and a pair of flaps to be formed into a pair of projecting portions on either side symmetrically with each other with respect to the central axis of the opening, closing the bottom portion of the cylindrical bag proper, superimposing said two flaps to be formed into the top end, sewing the so formed superimposed edges on both the sides of the longitudinal central axis of the bag proper, and superimposing corresponding edges of said paired flaps along said notches and sewing said superimposed edges to form a pair of projecting portions.

This process for manufacturing bags may be applied not only to the case where a sheet-like fabric material is used as the fabric, but also to the case where a tubular woven fabric formed by a circular loom or the like is used as the fabric.

DETAILED DESCRIPTION OF THE PREFERRED EMBODIMENTS

The structure and functional characteristics of the bag of the present invention will now be described in detail with reference to the preferred embodiments illustrated in the accompanying drawings.

Figure 1:
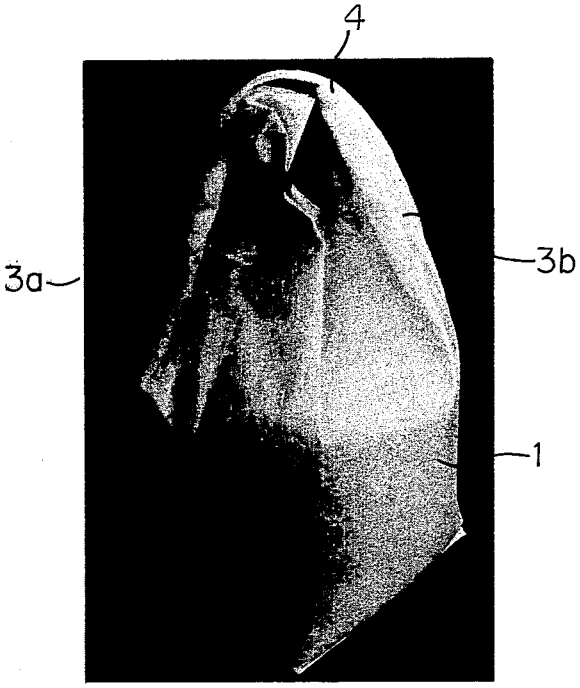
FIG. 1 is a perspective photograph showing one embodiment of the bag of the present invention, which bag is filled with a granular material.
Figure 5:
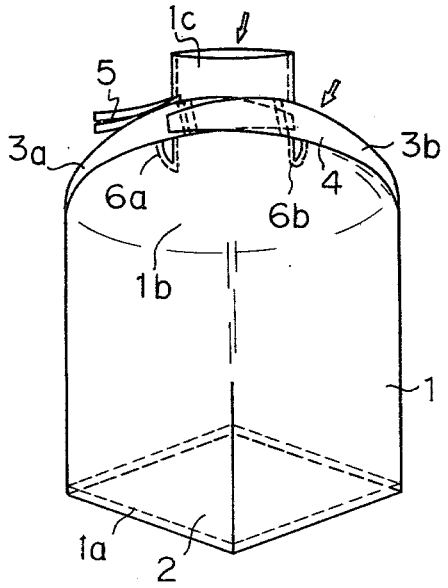
FIG. 5 is a perspective view showing a bag formed by integrally joining the top end portions on both sides of the central portion corresponding to the opening in the bag shown in FIG. 4 to form a hanging sling.

As shown in FIGS. 1 and 5, the bag of the present invention comprises a bag proper 1, a bottom piece 2 sewn to the bottom edge of the bag proper 1 along a seam 1*a*, an opening 1*c* formed in the central portion of the top end 1*b* which is formed integrally with the bag proper 1 and projecting parts 3*a* and 3*b* extending upwardly from the top end cover 1*b* with the opening 1*c* being interposed therebetween. The top ends of the parts 3*a* and 3*b* are sewn together to form a hanging sling 4. A string 5 is attached to the opening 1*c* so that after a material has been filled into the bag proper 1, the string 5 is tied to close the opening 1*c*.

In the above-mentioned bag, the top end 1*b* is a continuous part of the fabric material of the bag proper 1 and is sewn and closed by seams 6*a* and 6*b*. Since the seams 6*a* and 6*b* are located on the inner sides of the projecting parts 3*a* and 3*b* constituting the hanging sling 4, even when a granular material is filled into this bag and it is hung up and moved by using the hanging sling 4, the external force is not directly imposed on the seams 6*a* and 6*b*. Accordingly, opening of these seams 6*a* and 6*b* of the top end cover 1*b* or other trouble is not caused by external force at all. Furthermore, the top end 1*b* can easily be formed only by sewing the parts 3*a* and 3*b* along the seams 6*a* and 6*b*, and the bag of the present invention is characterized in that it can be manufactured very simply. Therefore, a strong and practical bag can be provided at a low manufacturing cost, according to the present invention.

In the foregoing embodiment, the bottom of the bag is constructed of one sheet-like piece. As is known, a bottom provided with a discharge opening may be used. Alternately, there may be adopted a method in which the lower edge of the bag proper 1 is divided into two corresponding parts, and they are superimposed together and sewn together along the superimposed edges to form a closed bottom of the bag proper 1.

The process for manufacturing the bag of the present invention from one sheet-like fabric material will now be described.

As will be apparent from the description given hereinafter, the bag of the present invention can be manufactured very easily according to the following steps.

Figure 2:
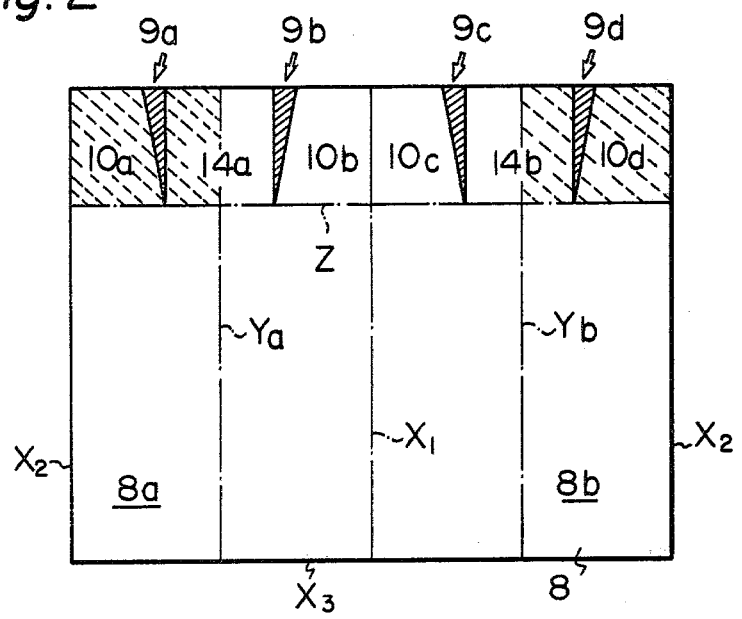
FIG. 2 is an exploded development of the bag being formed from one sheet of fabric, with the bottom end, constituting the bottom of the bag, and the portion reinforcing the hanging sling formed in the upper portion being removed.

(a) A rectangular fabric 8 comprising two units of rectangular fabric 8*a* and 8*b* having the same size and shape and being symmetrical with each other with respect to the line $X_1$ is formed as shown in FIG. 2. In the upper portion of the fabric 8, four notches 9*a*, 9*b*, 9*c* and 9*d* extending to an imaginary line Z parallel to the bottom edge $X_3$ of the fabric 8 are formed so that the portions 10*a*, 10*b*, 10*c* and 10*d* above the imaginary line Z satisfy the following requirements; the portions 10*a* and 10*b* should be symmetrical with each other with respect to the longitudinal central line Ya of the unit of fabric designated 8*a* and the portions 10*c* and 10*d* should be symmetrical with each other with respect to the longitudinal central line Yb of the unit of fabric designated 8*b*.

Figure 3:
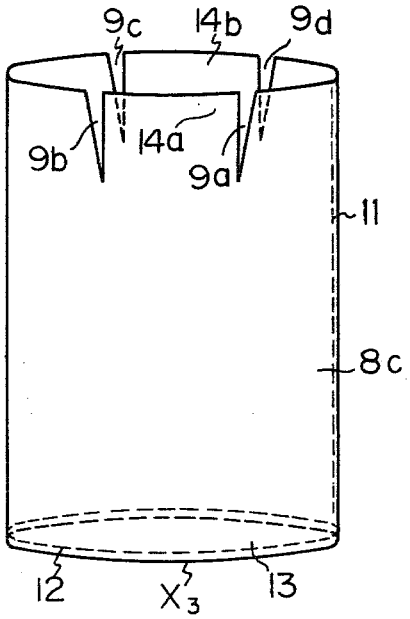
FIG. 3 is a perspective view showing the state in which the longitudinal edges of a single piece of woven fabric having the same shape and size as those of the sheet fabric shown in FIG. 2 are superimposed and sewn together.

(b) Then, the left and right edges, designated $X_2$ of the fabric 8 shown in FIG. 2, are superimposed together and sewn along a seam 11 to form a cylindrical bag shown in FIG. 3.

(c) A bottom piece 13 is sewn to the bottom edge $X_3$ of the cylindrical bag 8*c* along a seam 12 to form a bottom portion of the bag. Instead of the above-mentioned method using the bottom piece 13, there may be adopted a method in which the edge $X_3$ is divided in two equal parts and then superimposed and sewn together.

Figure 4:
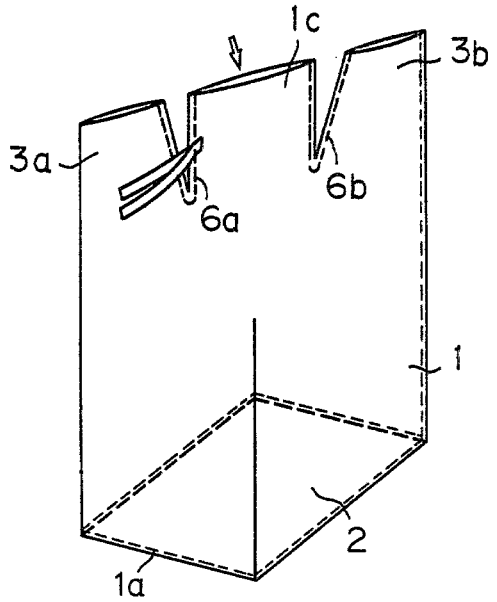
FIG. 4 is a perspective view showing a bag formed by sewing a bottom piece to the bottom edge of the fabric shown in FIG. 3 and sewing the edges of the upper notches.
Figure 6:
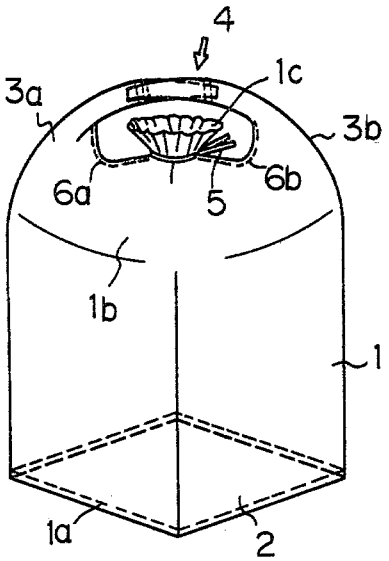
FIG. 6 is a perspective view illustrating the state in which a granular material is filled into the bag shown in FIG. 5 and the opening is closed by a string, which corresponds to the photograph shown in FIG. 1.

(d) Rectangular projections 14*a* and 14*b* formed on the imaginary line Z and including rectangular portions symmetrical with each other with respect to the central lines Ya and Yb, respectively, are superimposed and the pair of left and right longitudinal superimposed edges thus formed are sewn along seams 6*a* and 6*b*, respectively, to form a portion corresponding to a cylindrical opening 1*c* (see FIGS. 1, 5 and 6). Then, the corresponding edges of the notches 9*c* and 9*b* are superimposed together and the corresponding edges of the notches 9*a* and 9*b* are superimposed together, and the superimposed edges are sewn together along the seams 6*a* and 6*b*, whereby an intermediate product of the bag, shown in FIG. 4, is made. In this intermediate product, as shown in FIG. 4, three cylindrical flap portions are formed in the upper portion. A pair of the flaps located on either side is formed into projecting parts 3*a* and 3*b*, and the central flap is formed into an opening 1*c*. A tying string 5 is attached to the material-filling opening 1*c*. Thus, a bag shown in FIG. 4 is made.

(e) The top ends of the parts 3*a* and 3*b* are superposed together, and the portion is sewn and tightly joined to form a hanging sling 4.

In the so manufactured bag, since the seams 6*a* and 6*b* are located on the inner sides, the force imposed on the seams 6*a* and 6*b* when the filled bag is transported is very slight, and breakage of these seams 6*a* and 6*b* rarely occurs.

As will be apparent from the above-mentioned manufacturing process steps, althought the structure of the upper portion of the bag of the present invention is relatively complicated, the cutting and sewintg steps can be accomplished very easily and simply. This is one of the important features of the present invention.

The above-mentioned process for manufacturing the bag of the present invention is applied to the case where one sheet-like starting fabric is cut and sewn. The manufacturing process steps can be further simplified when a tubular woven fabric, formed by a circular loom or the like, is used as the starting fabric. In this case, the following step (f) is adopted instead of the above-mentioned steps (a) and (b).

(f) A tubular woven fabric having the same circumferential dimension as that of the intended bag is cut into the same length as that of the starting fabric shown in FIG. 2 and it is flattened so that two sheet-like material pieces are superimposed on each other. Then, notches similar to notches 9*a*, 9*b*, 9*c* and 9*d* formed on two fabric units 8*a* and 8*b* as shown in FIG. 2 are formed. By this operation, an intermediate product of the bag, as shown in FIG. 3, is made. Then, this intermediate product is subjected to the same sewing steps as described hereinbefore, and the intended bag is made.

Figure 7:
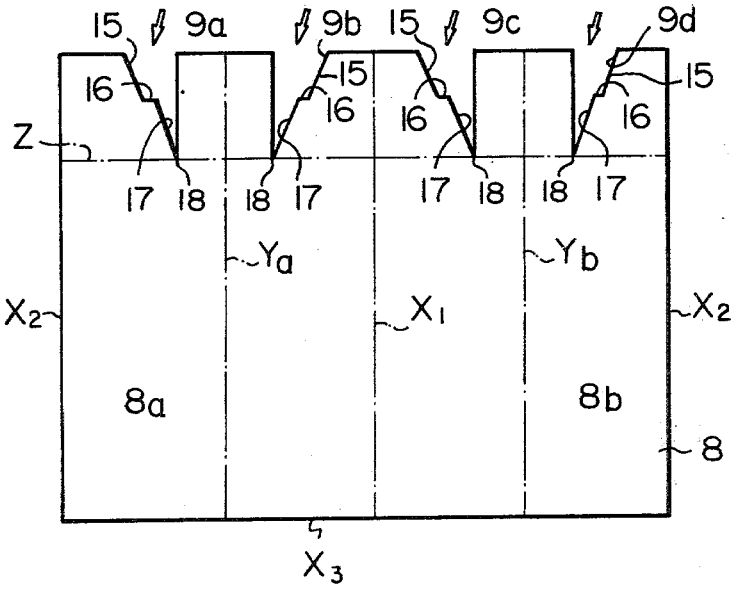
FIG. 7 is a development of another embodiment of the bag of the present invention, which is similar to FIG. 2.

In the bag having the above-mentioned structure, seams in the vicinity of the material-filling opening 1 are rarely broken while the bag is actually being used in the filled state. However, in order to reinforce these seams, it is preferred that the notches 9*a*, 9*b*, 9*c* and 9*d* be formed to have a stepped shape as shown in FIG. 7. In fact, by experiments, it was confirmed that a very high reinforcing effect can be attained by this arrangement. Referring to FIG. 7, the inclined portion of each notch includes two inclined parts 15 and 17 and a horizontal step 16 interposed therebetween. If the inclined portion of each notch is not linearly inclined but a horizontal step 16 is formed in the midway, even when a load is imposed on the seams (corresponding to seams 6*a* and 6*b* in the above-mentioned embodiment) while the bag is actually being used, the load is dispersed at the horizontal step 16 and therefore, the resistance to the load is increased. Therefore, even if the bag made of the sheet, shown in FIG. 7, is hung with a hanging sling under an unbalanced condition, the lowest ends 18 of the notches 9*a*, 9*b*, 9*c*, and 9*d* can be prevented from tearing.

The fabric of the embodiment shown in FIG. 7 is the same as that shown in FIG. 2, except for the above-mentioned special configuration of each notch. Accordingly, explanations of the fabric and the steps of sewing the fabric are omitted.

Alternatively, instead of the above-mentioned horizontal steps 16, short cuts can be made, which cuts are positioned in a place corresponding to the horizontal step 16. In this case, seams 6*a* and 6*b* are formed around the edges of the notches 9*a*, 9*b*, 9*c* and 9*d* the short cuts. The resultant bag has the same function as that of the bag from the fabric in FIG. 7.

Figure 8:
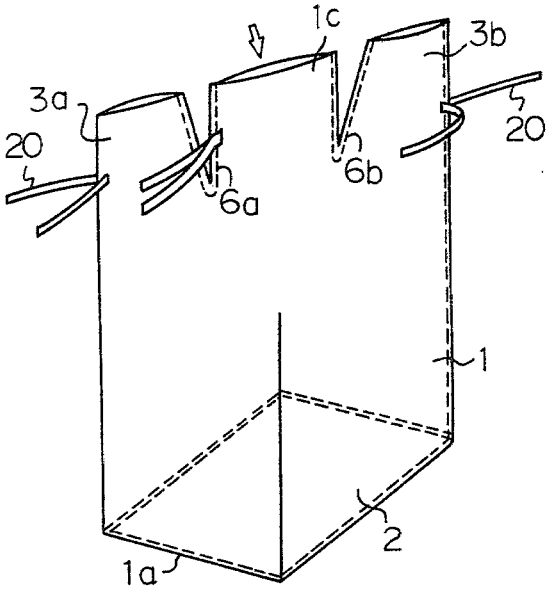
FIG. 8 is a perspective view of another embodiment of the present invention, showing the state, similar to FIG. 4.
Figure 9:
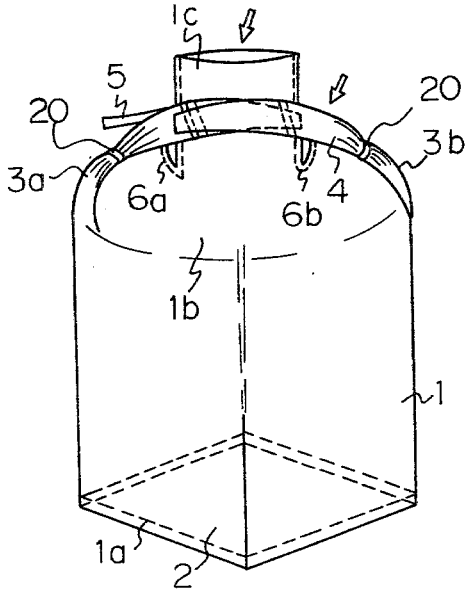
FIG. 9 is a perspective view of the embodiment of FIG. 8, showing the state similar to FIG. 5.
Figure 10:
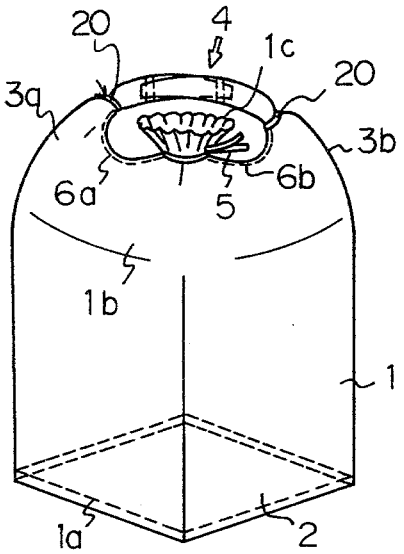
FIG. 10 is a perspective view of the embodiment of FIG. 8, showing the state similar to FIG. 6.

Another preferred embodiment of the present invention is shown in FIGS. 8, 9 and 10, which has the same structure as that of the bag shown in FIGS. 4, 5 and 6 except for the parts 3*a* and 3*b*. In this embodiment, strings 20 are attached to the projection parts 3*a* and 3*b* respectively (see FIG. 8). After superposing the top ends of the parts 3*a* and 3*b* and sewing the superposed portion 4*a* to form a hanging sling 4, the hanging sling is tied by the strings 20 (see FIG. 9). After a granular material has been filed in the bag, the opening 1*c* is tied and closed by the string 5 (see FIG. 10).

According to this embodiment, when a bag filled with material is hung up at the center portion of the sling 4, the weight of the bag is uniformly distributed in the sling because the sling is tied by the strings 20. That is, a concentration of weight does not occur on any one portion of the sling, so that the lowest ends of the notches 9*a*, 9*b*, and 9*c* (see FIG. 2) and the sling are prevented from being torn even if the bag is subjected to a shock.

In the above-mentioned embodiments, a connected part of a sling wherein projecting parts 3*a* and 3*b* are connected to each other, may be reinforced by an appropriate reinforced material.

In the connected part of the sling, ends of the projecting parts 3*a* and 3*b* may be respectively folded and then connected to each other.

As will be apparent from the above illustration, the bag of the present invention is very excellent in its functions, and furthermore, it can be manufactured very easily and simply. Therefore, the bag of the present invention is very valuable for storing and transporting bulk materials.

From the economical viewpoint, a woven fabric formed by using flat yarns of a polyolefin, such as polyethylene or polypropylene as warps and wefts, is preferably employed as the starting fabric. Of course, woven fabrics formed by using other synthetic fiber yarns or natural hemp yarns as warps and wefts can be used in the present invention.

As will be apparent to those skilled in the art, various modifications can be made to the above-mentioned preferred embodiments of the bag of the present invention, based on the basic technical concept of the present invention.

We claim:

1. A bag comprising a bag body having a bottom and an upper portion with a top end extending from the upper portion, an opening formed in the top end and a hanging sling formed on the upper portion of the bag body, said top end including a cylindrical portion having the opening formed in the central part thereof and two projecting portions formed symmetrically on either side of the cylindrical portion, said projecting portions being closed, on the sides nearest the cylindrical portion, along seams which extend from both projecting portions to the edge of the opening of the cylindrical portion, and cloth flaps comprising the cylindrical portion being sewn along said seams, wherein said seams are located on a plane which passes through the central axis of the cylindrical portion.

2. A bag as set forth in claim 1 wherein a tying string is attached to the cylindrical portion.

3. A bag as set forth in claim 1 wherein both the projecting portions are connected together by sewing to provide a hanging sling.

4. A bag as set forth in claim 1 wherein a step is formed on each of the seams on the sides of both the projecting portions nearest the cylindrical portion.

5. A bag as set forth in claim 1 wherein strings are attached to both the projecting portions respectively to provide means to tie the projecting portions with strings.

6. A bag as set forth in claim 1 which is composed of a starting woven fabric formed from polyolefin flat yarns as warps and wefts.

7. A process for manufacturing bags which comprises; forming a cylindrical bag body having a bottom and an upper portion having in the upper portion thereof a part to be formed into a top end, said part to be formed into the top end being divided by notches into two flaps to be formed into a cylindrical portion provided with an opening and a pair of flaps having edges to be formed into a pair of projecting portions on either side, symmetrical with each other, with respect to the central axis of the opening; closing the bottom portion of the cylindrical bag body; superimposing said two flaps to be formed into said cylindrical portion; sewing the so formed superimposed flaps on both sides parallel to the longitudinal central axis of the bag body; superimposing corresponding edges of said paired flaps along said notches; sewing said superimposed edges to form a pair of projecting portions; and connecting the top ends of said projecting portions with each other.

8. A process for manufacturing bags according to claim 7, which further comprises steps of attaching a string to said cylindrical portion and attaching strings to said projecting portions respectively.

9. A process for manufacturing bags according to claim 7 wherein said cylindrical bag body is made by forming one sheet-like starting fabric by cutting; superimposing; and sewing the edges of the portion of the fabric to be formed into the bag body.

10. A process for manufacturing bags according to claim 7 wherein said cylindrical bag body is made by cutting a tubular woven fabric.

11. A process for manufacturing bags according to claim 7 wherein the bottom of the cylindrical bag body is formed by sewing the bottom edge of the cylindrical bag body to a bottom end piece.

12. A process for manufacturing bags according to claim 7 wherein the bottom of said cylindrical bag body is closed by dividing the bottom edge of said cylindrical bag body into two equal parts; superimposed the divided bottom edge and sewing these equal parts to each other.

13. A process for manufacturing bags according to claim 7 wherein each of said notches has a step in the middle thereof.

* * * * *